US007665324B2

(12) United States Patent
Kim et al.

(10) Patent No.: US 7,665,324 B2
(45) Date of Patent: Feb. 23, 2010

(54) DOOR DUCT ASSEMBLY FOR REFRIGERATOR

(75) Inventors: Jin-Hyun Kim, Incheon (KR); Moon-Won Kim, Changwon (KR); Hyeong-Ii Kim, Kimhae (KR); Hae Lyong Gu, Kimhae (KR); Seung-Jin Choi, Kimhae (KR)

(73) Assignee: LG Electronics Inc., Seoul (KR)

( * ) Notice: Subject to any disclaimer, the term of this patent is extended or adjusted under 35 U.S.C. 154(b) by 348 days.

(21) Appl. No.: 11/813,421

(22) PCT Filed: Jan. 6, 2006

(86) PCT No.: PCT/KR2006/000068

§ 371 (c)(1),
(2), (4) Date: Jul. 5, 2007

(87) PCT Pub. No.: WO2006/073288

PCT Pub. Date: Jul. 13, 2006

(65) Prior Publication Data

US 2008/0115522 A1 May 22, 2008

(30) Foreign Application Priority Data

| | | |
|---|---|---|
| Jan. 6, 2005 | (KR) | 10-2005-0001378 |
| Jan. 27, 2005 | (KR) | 10-2005-0007442 |
| Jan. 27, 2005 | (KR) | 10-2005-0007449 |
| Jan. 27, 2005 | (KR) | 10-2005-0007451 |
| Jan. 28, 2005 | (KR) | 10-2005-0008112 |
| Jan. 28, 2005 | (KR) | 10-2005-0008113 |

(51) Int. Cl.
*F25D 17/04* (2006.01)
*F24F 3/16* (2006.01)

(52) U.S. Cl. ..... 62/407; 62/404; 62/78

(58) Field of Classification Search ..... 62/78, 62/264, 344, 348, 404–405, 407–408, 412–414, 62/441, 444
See application file for complete search history.

(56) References Cited

U.S. PATENT DOCUMENTS 5,584,191 A 12/1996 Kwon et al.

(Continued)

FOREIGN PATENT DOCUMENTS

JP 63-7776 U 11/1994

(Continued)

*Primary Examiner*—Frantz F Jules
*Assistant Examiner*—Emmanuel Duke
(74) *Attorney, Agent, or Firm*—Birch, Stewart, Kolasch & Birch, LLP

(57) ABSTRACT

The present invention relates to a door duct assembly for a refrigerator. In the present invention, the cold air delivered from a cold air duct of a refrigerator main body to a door 30 through a cold air communication portion 55 is discharged into a storage space through cold air vents 61 formed in a flow guide 60. The cold air communication portion 55 is formed in a door basket 40 or the flow guide 60. The door baskets 40 or the flow guide 60 is mounted on a door liner 33 defining a rear surface of the door 30. According to the present invention, there are advantages in that it is relatively easy to manufacture a door, the cold air flows uniformly in the door, the strength of the flow guide for defining a flow channel in the door is relatively increased, and dewdrops are prevented from being formed upstream of the flow channel.

25 Claims, 13 Drawing Sheets

U.S. PATENT DOCUMENTS

| | | | | |
|---|---|---|---|---|
| 5,979,174 | A * | 11/1999 | Kim et al. | 62/404 |
| 5,996,370 | A * | 12/1999 | Lee | 62/407 |
| 6,401,482 | B1 * | 6/2002 | Lee et al. | 62/408 |
| 6,918,259 | B2 * | 7/2005 | Anderson et al. | 62/78 |
| 2003/0126881 | A1 * | 7/2003 | Lee et al. | 62/407 |
| 2008/0148761 | A1 * | 6/2008 | Venkatakrishnan et al. | 62/340 |

FOREIGN PATENT DOCUMENTS

| | | | |
|---|---|---|---|
| JP | 7-218090 | A | 8/1995 |
| JP | 11-101569 | A | 4/1999 |
| JP | 11-304336 | A | 11/1999 |

* cited by examiner

DOOR DUCT ASSEMBLY FOR REFRIGERATOR

TECHNICAL FIELD

The present invention relates to a refrigerator, and more particularly, to a door duct assembly for a refrigerator, which is provided on a rear surface of a refrigerator door to discharge cold air from the door into a refrigerating chamber.

BACKGROUND ART

A refrigerator keeps stored goods such as foods by setting the interior of a storage space at a desired temperature. In general, cold air generated by means of an evaporator is supplied into the storage space. When there are a plenty of goods stored in the storage space, the cold air may not smoothly flow therein.

In order to solve the problem, the cold air is supplied from a door side into the storage space. To this end, there has been disclosed a technique by which cold air is delivered to a door and supplied from the door into a storage space. FIGS. 1 and 2 show a refrigerator to which such a technique is applied.

As shown in the figures, a refrigerator main body 2 comprises an outer case 4 of a steel plate and an inner case 6 molded out of synthetic resin installed in the outer case 4, which define an appearance. An insulation layer 7 is formed in a space between the outer and inner cases 4 and 6.

A freezing chamber 8 and a refrigerating chamber 9, as storage spaces, are defined in upper and lower inner portions of the refrigerator main body 2. A heat exchange chamber 10 is provided at the rear of the freezing chamber 8 to generate cold air. An evaporator 11 is installed in the heat exchange chamber 10. The cold air generated in the heat exchange chamber 10 is supplied into the freezing and refrigerating chambers 8 and 9. In general, the cold air generated in the heat exchange chamber 10 is supplied from the rear of the freezing and refrigerating chambers 8 and 9 into the freezing and refrigerating chambers 8 and 9.

Doors 12 and 14 are installed at front faces of the freezing and refrigerating chambers 8 and 9, respectively. Each of the doors 12 and 14 is pivotable with a side thereof supported by the refrigerator main body 2, and selectively opens and closes each of the freezing and refrigerating chambers 8 and 9. The doors 12 and 14 are provided with structures that are supplied with the cold air generated in the heat exchange chamber 10 and then supply the cold air to the freezing and refrigerating chambers 8 and 9. Here, referring to the door 14 shown in FIG. 2 for opening and closing the refrigerating chamber 9, a structure for supplying the cold air will be described.

A rear surface of the door 14 is defined by a door liner 15, which is generally formed of synthetic resin. In addition, other portions of the door 14 with the exception of its rear surface are defined by a door exterior plate 16. A support protrusion 17 is formed around a marginal portion of the door liner 15 defining the rear surface of the door 14. The support protrusion 17 serves to support both ends of a door basket 20. A plurality of horizontal protrusions 18 are formed to connect both side portions of the support protrusion 17 to each other while being spaced apart from one another at predetermined intervals. The horizontal protrusion 18 serves to support a bottom surface of the door basket 20. Reference numeral 19 designates catching portions for fixing the door basket 20.

The door basket 20 is installed on the rear surface of the door 14. An accommodation space 22, which is open toward a substantially upper portion of a basket body 21 made of synthetic resin, is defined in the door basket 20. Both ends of a rear surface of the door basket 20 are formed with hook portions 24 which are caught by the catching portions 19, respectively.

In the meantime, a cold air communication portion 26 is provided in a side portion of the support protrusion 17. When the door 14 is closed, the cold air communication portion 26 is a portion which communicates with a cold air duct (not shown) provided on a side of the refrigerator main body 2 and to which the cold air is delivered. A flow guide 28 is provided at a lower end of the horizontal protrusion 18 adjacent to the portion of the support protrusion 17 where the cold air communication portion 26 is provided. A rear surface of the flow guide 28, a bottom surface of the horizontal protrusion 18, and a portion of the door liner 15 defining the rear surface of the door 14 define a duct in which a flow channel is defined. The flow channel serves to guide the cold air from the door 14 to the front of the refrigerating chamber 9. To this end, a plurality of cold air vents 29 are formed through the flow guide 28.

However, the refrigerator according to the aforementioned prior art has the following problems.

The flow channel through which the cold air flows is defined in the rear surface of the door 14 by the door liner 15, the horizontal protrusion 18, and the flow guide 28. In order to supply the cold air into the flow channel, the cold air communication portion 26 should be formed to penetrate through the support protrusion 17. However, since an insulation layer is formed in the support protrusion 17, there is a problem in that it is difficult to form the cold air communication portion 26 such that the cold air passes through the support protrusion 17 and is delivered into the flow channel. That is, the difficulty is produced in that the cold air communication portion 26 should be formed to penetrate through the support protrusion 17 and a foam liquid should not leak from the cold air communication portion 26 upon manufacture of the door 14.

Further, in the prior art, since the cold air communication portion 26 is provided in the support protrusion 17 of the door liner 15 defining the rear surface of the door 14, there is a problem in that in case of a refrigerator that does not require the cold air communication portion 26 among a variety of refrigerators, a different door liner 15 without the cold air communication portion 26 should be separately manufactured. That is, there is a problem in that the door liner 15 is not compatible.

In addition, since the flow channel defined by the door liner 15, the horizontal protrusion 18 and the flow guide 28 between the both side portions of the support protrusion 17 has a flow cross-sectional area relatively larger than that of the cold air communication portion 26, there are problems in that severe swirl occurs in the flow channel and the cold air is not uniformly discharged through the cold air vents 29.

Next, in the prior art, there is a problem in that dewdrops are formed on the support protrusion 17 around the cold air communication portion 26 and the flow guide 28 adjacent to the support protrusion 17 due to temperature difference.

In addition, the flow guide 28 is installed on the rear surface of the door 14 to extend from side to side, so that the flow guide 28 can define the flow channel in cooperation with the door liner 15. Therefore, the cold air does not leak only when the flow guide 28 is in close contact with the door liner 15. However, when the flow guide 28 extends from side to side or gets deformed due to use for a long time, the flow guide 28 is not brought into close contact with the door liner 15. Thus, there is a problem in that a gap occurs between the flow guide 28 and the door liner 15, resulting in leakage of the cold air.

Of course, although the cold air is delivered into the storage space even when the cold air leaks from between the flow guide 28 and the door liner 15, the cold air cannot be delivered in desired directions. Thus, there are problems in that it is impossible to get rapid cooling effects and the goods stored in the door basket 20 below the flow guide 28 are overcooled.

In addition, the storage space in the refrigerator is made nearly airtight, and external air can be introduced thereinto only when the doors 12 and 14 are opened and closed. Thus, odor generated from the goods kept in the storage space or other harmful components repeatedly circulate in the refrigerator together with the cold air. In such a case, there are problems in that other goods kept in the storage space are affected, and an odor occurs or mold propagates in the storage space.

DISCLOSURE

Technical Problem

Accordingly, the present invention is conceived to solve the aforementioned problems in the prior art. An object of the present invention is to enable attachment or detachment of a cold air communication portion, which is supplied with cold air through a duct provided in a refrigerator main body and then supplies the air to a door, to or from the door.

Another object of the present invention is to cause cold air supplied through a duct provided in a refrigerator main body to relatively uniformly flow in a flow channel formed in a door.

A further object of the present invention is to secure thermal insulation between a duct provided in a refrigerator main body and a flow channel formed in a door and connected to the duct.

A still further object of the present invention is to cause a flow guide defining a flow channel in cooperation with a door liner, which defines a rear surface of a door, to be installed while being brought into close contact with the door liner.

A still further object of the present invention is to cause a flow guide to be securely supported by a door liner without deformation although the flow guide defining a flow channel becomes relatively elongated.

A still further object of the present invention for solving the aforementioned problems in the prior art is to remove an odor or a harmful component from cold air circulating in a refrigerator.

A still further object of the present invention is to enable a user to replace a structure for removing an odor or a harmful component from cold air circulating in a refrigerator with a new one.

Technical Solution

According to an aspect of the present invention for achieving the objects, there is provided a door duct assembly for a refrigerator, comprising: a cold air communication portion detachably installed on a door for opening and closing a storage space of a refrigerator main body, the cold air communication portion including a connecting duct selectively connected to a cold air duct of the refrigerator main body; and a flow guide for defining a flow channel in cooperation with a door liner defining a rear surface of the door, the flow channel allowing the cold air supplied through the cold air communication portion to flow there through, the flow guide being formed with a plurality of cold air vents for discharging the cold air in the flow channel, the flow guide having a distal end that comes into contact with the door liner.

The flow guide is mounted on a basket body having an accommodation space for storing goods, the accommodation space being open upward, and the flow guide is fixed together with the basket body to the door.

The cold air communication portion is provided at an end of any one of the flow guide and the basket body.

The cold air communication portion is provided with a connecting duct made of an elastic material.

A flow channel formation rib is formed on a rear surface of the flow guide, the flow channel formation rib defines a flow channel with a flow cross-sectional area that is not larger than that of the connecting duct, and a distal end of the flow channel formation rib comes into contact with the door liner.

The hook portions are formed at both ends of the basket body to be caught by catching portions formed on the door liner, and each of the catching portions comprises a guide portion vertically extending from a surface of the door liner and a catching piece formed vertically to the guide portion at a leading end thereof.

The hook portions are formed at both ends of the basket body to be caught by catching portions formed on the door liner, each of the catching portions is formed to protrude from the surface of the door liner, and a stopper is formed adjacent to the catching portion to protrude less than the catching portion.

The present invention further comprise an insulation flow channel body causing the flow channel defined by the flow guide and the cold air communication portion to communicate with each other, the insulation flow channel body being formed to have a flow cross-sectional area that is not larger than that of the connecting duct.

The insulation flow channel body comprises a first flow channel body having an inlet in communication with the connecting duct, and a second flow channel body formed with a communication passage having a side communicating with the inlet of the first flow channel body and the other side communicating with a rib defined by a flow channel formation rib formed on a rear surface of the flow guide.

The cold air communication portion is formed to penetrate through one of connecting skirts formed to downwardly extend at both ends of a door basket, and both ends of the flow guide are positioned between the connecting skirts.

The present invention further comprise a connecting portion formed at a portion of the flow guide, wherein the connecting portion communicates with the flow channel defined by the flow guide and the door liner and is supplied with the cold air and then discharges the cold air, and the interior of the connecting portion is selectively opened and closed by a mounting cover detachably mounted on the connecting portion and provided with a plurality of cold air vents.

The mounting cover is formed to contain at least one of a deodorization component and an anion generating component.

A deodorizer for removing an odor from the cold air is further provided within the connecting portion covered with the mounting cover, and the deodorizer is fixed to a rear surface of a front plate defining the front surface of the mounting cover.

A fixing rib for fixing the deodorizer is provided on the rear surface of the front plate of the mounting cover According to other aspect of the present invention for achieving the objects, there is provided a door duct assembly for a refrigerator, comprising: a cold air communication portion detachably installed on a door for opening and closing a storage space of a refrigerator main body, the cold air communication portion including a connecting duct selectively connected to a cold air duct of the refrigerator main body; a flow guide for defining a flow channel in cooperation with a door liner defining a rear surface of the door, the flow channel allowing the cold air supplied through the cold air communication portion to flow therethrough, the flow guide having a rear surface on which a flow channel formation rib is provided to define the flow channel; and an insulation flow channel body causing the flow channel defined by the flow guide and the cold air communication portion to communicate with each other, the insulation flow channel body being installed by inserting at least two flow channel bodies made of an insulating material into the rear surface portion of the flow guide.

The flow channel formation rib has a distal end that comes into contact with the door liner to define a flow channel with a flow cross-sectional area that is not larger than that of the connecting duct, and a flow channel defined in the insulation flow channel body has a flow cross-sectional area that is formed not to be larger than that of the connecting duct.

The insulation flow channel body comprises a first flow channel body having an inlet in communication with the connecting duct, and a second flow channel body formed with a communication passage having a side communicating with the inlet of the first flow channel body and the other side communicating with a flow channel defined by a flow channel formation rib.

The cold air communication portion is formed to penetrate through one of connecting skirts downward extending at both ends of a door basket, and both ends of the flow guide are positioned between the connecting skirts at both the ends of the door basket.

The flow channel formation rib is "ㄷ"-shaped to be elongated in a widthwise direction on the rear surface of the flow guide, and is further provided with a converging portion upstream of a flow of cold air, the converging portion causing the cross-sectional area of the flow of cold air to be reduced.

A plurality of cold air vents are formed at an area of the flow guide divided by the flow channel formation rib, and the cold air is discharged into the storage space through the cold air vents in the area divided by the flow channel formation rib.

A connecting portion is further provided in an intermediate portion of the flow guide, the connecting portion comprising an insertion hole and a catching hole communicating therewith, the insertion hole and the catching hole having different diameters from each other and communicating with the flow channel defined by the flow guide and the door liner, the cold air is supplied to and discharged through the insertion hole and catching hole, and the door liner further comprises a supporting/catching member at position corresponding to the connecting portion, the supporting/catching member comprising a catching plate with a diameter larger than that of the catching hole at a distal end of a connecting neck portion with a relatively smaller diameter, thereby enabling the connecting portion to be caught and supported by the supporting/catching member.

The connecting portion is formed to be recessed when viewed from the front of the flow guide, and a plurality of catching slots are formed around an inner peripheral portion of the connecting portion.

A mounting cover is detachably mounted on the connecting portion, the mounting cover comprising a front plate which covers the interior of the connecting portion and through which a plurality of cold air vents are formed, and a side wall formed with an insertion guide and a catching hook around an edge of the front plate, the insertion guide and the catching hook being caught in the catching slots.

The mounting cover is formed to contain at least one of a deodorization component and an anion generating component.

A deodorizer for removing an odor from the cold air is further provided within the connecting portion covered with the mounting cover.

The deodorizer is fixed to a rear surface of a front plate defining the front surface of the mounting cover, and a fixing rib into which an edge of the deodorizer is fitted is provided on the rear surface of the front plate.

According to an aspect of the present invention for achieving the objects, there is provided a door duct assembly for a refrigerator, comprising: a cold air communication portion detachably installed on a door for opening and closing a storage space of a refrigerator main body, the cold air communication portion including a connecting duct selectively connected to a cold air duct of the refrigerator main body; a flow guide for defining a flow channel in cooperation with a door liner defining a rear surface of the door, the flow channel allowing the cold air supplied through the cold air communication portion to flow therethrough, the flow guide being formed with a plurality of cold air vents for discharging the cold air into the storage space; a connecting portion formed in a portion of the flow guide, the connecting portion communicating with the flow channel defined by the flow guide and the door liner and being supplied with the cold air and discharging the cold air; a mounting cover detachably installed on the connecting portion to selectively open and close the interior of the connecting portion, the mounting cover comprising a plurality of cold air vents; and a deodorizer installed within the connecting portion covered with the mounting cover to remove an odor from the cold air.

The connecting portion is formed to be recessed when viewed from the front of the flow guide, and a plurality of catching slots are formed around an inner peripheral portion of the connecting portion.

The mounting cover comprises a front plate which covers the interior of the connecting portion and through which a plurality of cold air vents are formed, and a sidewall formed with an insertion guide and a catching hook around an edge of the front plate, the insertion guide and the catching hook being caught in the catching slots.

The mounting cover comprises a front plate which covers the interior of the connecting portion and through which a plurality of cold air vents are formed, a side wall formed around an edge of the front plate, a hinge portion causing the mounting cover to be pivotably connected to the connecting portion, and a catching hook installed at a position opposite to the hinge portion, the catching hook causing the mounting cover to be caught by and fixed to the connecting portion.

The deodorizer is fixed to a rear surface of a front plate, and a fixing rib for fixing the deodorizer is provided on the rear surface of the front plate.

The mounting cover is formed to contain at least one of a deodorization component and an anion generating component.

According to another aspect of the present invention for achieving the objects, there is provided a door duct assembly mounting structure for a refrigerator, comprising: a cold air communication portion detachably installed on a door for opening and closing a storage space of a refrigerator main body, the cold air communication portion including a connecting duct selectively connected to a cold air duct of the refrigerator main body; a flow guide for defining a flow channel in cooperation with a door liner defining a rear surface of the door, the flow channel allowing the cold air supplied through the cold air communication portion to flow therethrough, the flow guide being formed with a plurality of cold air vents for discharging the cold air into the storage space, the flow channel having both ends caught by the door liner; a connecting portion formed at an intermediate portion of the flow guide, the connecting portion communicating with the flow channel defined by the flow guide and the door liner and being supplied with the cold air and then discharging the cold air, the connecting portion comprising an insertion hole and a catching hole that are communicate with each other and have different diameters; and a supporting/catching member provided on the door liner at a position corresponding to the connecting portion, the supporting/catching member comprising a catching plate with a diameter larger than that of the catching hole at a distal end of a connecting neck portion with a relatively smaller diameter, thereby enabling the connecting portion to be caught and supported by the supporting/catching member.

The flow guide is coupled to a door basket installed on a rear surface of the door, and hook portions are formed at both ends of the door basket to be caught by catching portions formed on the door liner.

The hook portions are formed at both ends of the flow guide to be caught by catching portions formed on the door liner, and the cold air communication portion is provided to penetrate through any one of both the ends thereof.

The stoppers are formed above the catching portions formed on the door liner, the stoppers protruding less than the catching portions to prevent the door basket or the flow guide from being detached.

The supporting/catching member comprises a mounting plate mounted on the door liner, a connecting neck portion provided on the mounting plate to have a length corresponding to the thickness of a rim of the catching hole, and a catching plate provided at a distal end of the connecting neck portion so as to correspond to the shape and size of the insertion hole.

The deodorizer is fixed to a rear surface of a front plate, and a fixing rib for fixing the deodorizer is provided on the rear surface of the front plate.

The mounting cover is formed to contain at least one of a deodorization component and an anion generating component.

ADVANTAGEOUS EFFECTS

According to a door duct assembly mounting structure for a refrigerator of the present invention so constructed, the following advantages can be expected.

First, in the present invention, a cold air communication portion, which is supplied with cold air through a duct provided in a refrigerator main body and then supplies the air to a door, is detachably installed at the door. That is, the cold air communication portion is provided at a basket installed on the door or at the flow guide installed on the basket. Thus, there are advantages in that the configuration of the door liner defining a rear surface of the door becomes simple and it is easy to form an insulation layer in the door.

Further, in the present invention, since the cold air communication portion is formed in a door basket or flow guide with a relatively small size, there is an advantage in that an identical door liner can be used for doors which require and do not require the cold air communication portion, and thus, a manufacturer can produce a variety of articles at a lower price.

Meanwhile, in the present invention, since a flow cross-sectional area of a flow channel formed in the door is configured not to be rapidly changed, the cold air can be discharged into the storage space relatively uniformly throughout the flow channel extending from side to side. Particularly, since there is provided a converging portion upstream of the flow channel defined by a flow channel formation rib and thus the cold air delivered between both side portions of the flow channel formation rib can flow more uniformly, there is an advantage in that the storage space can be more uniformly cooled.

Further, in the present invention, since the flow guide defining a flow channel in the door is supported on the door liner by the flow channel formation rib, there is an advantages in that the strength of the flow guide is relatively increased and deformation or breakage of the flow guide due to an external force is minimized, resulting in increased reliability of articles.

Next, in the present invention, the flow channel defined by the flow channel formation rib and the cold air communication portion communicate with each other using an insulation flow channel body. The insulation flow channel body makes it possible to prevent dewdrops from being formed on the surface of the flow guide due to a temperature difference between the cold air delivered from the refrigerator main body to the door side and the air on the surface of the flow guide.

In addition, according to the present invention, both ends of the flow guide of the door duct assembly are caught by support protrusions of the door, while a central lower portion of the flow guide is caught by a supporting/catching member provided on the door liner. Thus, the flow guide is brought into close contact with the surface of the door liner, so that the cold air is prevented from leaking through a gap between the door liner and the flow guide and the flow guide is prevented from being deformed.

Furthermore, in the present invention, the door duct assembly, particularly the flow guide is securely assembled to the door liner, and hook portions formed on both ends of a basket body are caught by stoppers positioned above catching portions of the door liner. Thus, there is an advantage in that the door duct assembly is not inadvertently separated from the door.

In addition, according to the present invention, a mounting cover containing a cold air purification component is configured to be detachably mounted on a connecting portion of the flow guide. Thus, a portion of the cold air discharged through the door duct assembly is deodorized, or is supplied into the storage space together with anions. Finally, there are advantages in that the storage space can be deodorized or the stored goods can be kept fresher.

Particularly, since the mounting cover can be detachably mounted, a user can easily replace it. In addition, since the mounting cover can be mounted on the connecting portion when a user begins to utilize the mounting cover, there is an advantage in that it is possible to use the cold air purification component more effectively.

Furthermore, in the present invention, a deodorizer that can remove an odor is positioned in the connecting portion in a state where the deodorizer is covered with the mounting cover. Thus, the cold air discharged through the connecting portion of the door duct assembly is deodorized and then supplied into the storage space. Finally, since an odor of the storage space is removed, there is an advantage in that an odor does not permeate other stored goods.

In addition, since the mounting cover can be detachably mounted, it is possible for a user to easily replace the deodorizer. Particularly, since the deodorizer can be mounted when a user begins to utilize a refrigerator, there is an advantage in that it is possible to use the deodorizer more effectively.

BEST MODE

Figure 1:
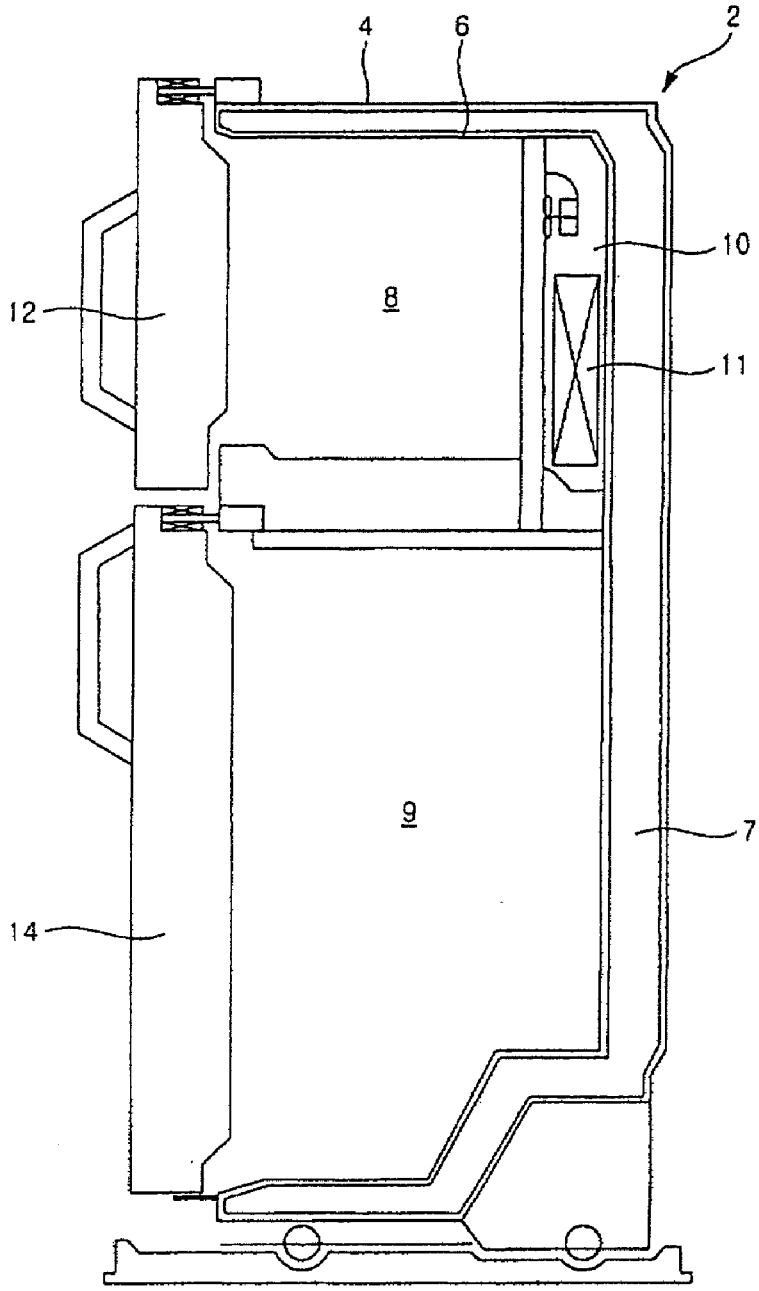
FIG. 1 PRIOR ART
FIG. 1 is a side sectional view showing the interior of a conventional refrigerator.
Figure 2:
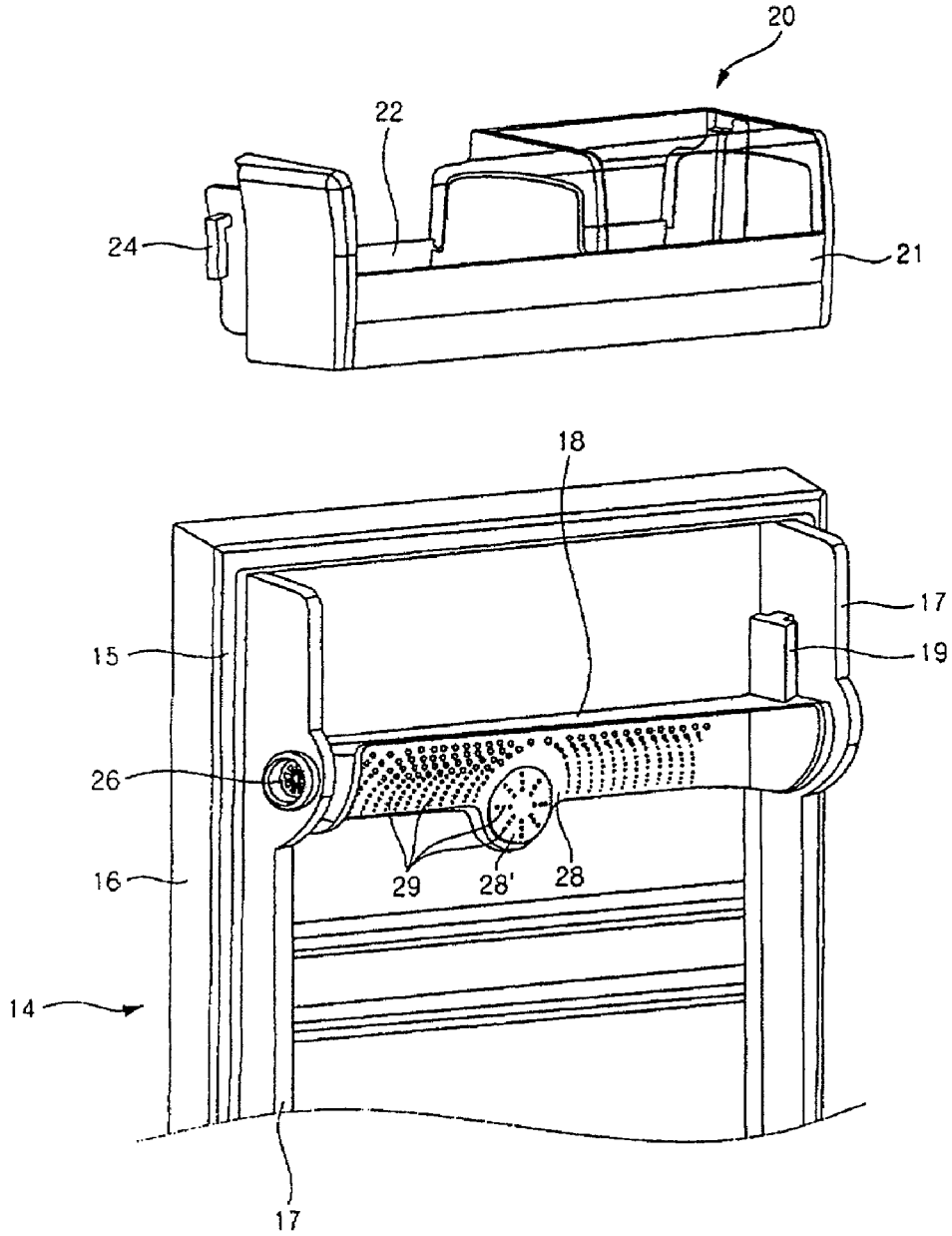
FIG. 2 PRIOR ART
FIG. 2 is an exploded perspective view showing major portions of a door duct of the conventional refrigerator.
Figure 3:
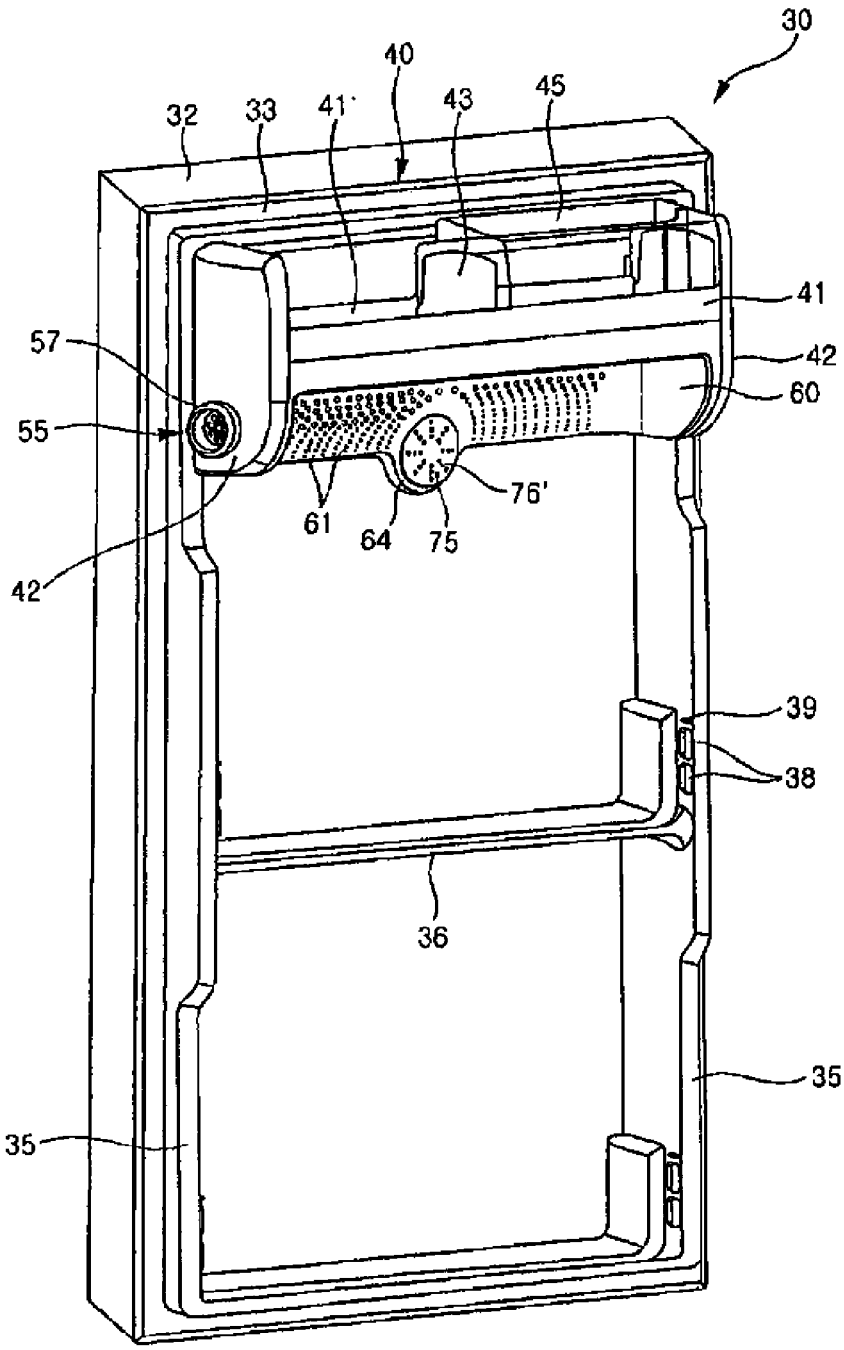
FIG. 3 is a perspective view showing a door in which a preferred embodiment of a door duct assembly for a refrigerator according to the present invention is employed.

As shown in the drawings, a door 30 selectively opens and closes a storage space formed in a refrigerator main body (not shown). External appearances of front, both sides, upper and lower surfaces of the door 30 are defined by a door exterior plate 32, while a rear surface of the door 30 is defined by a door liner 33. The door exterior plate 32 is generally formed of metal, and the door liner 33 is formed of synthetic resin.

A support protrusion 35 is formed around a marginal portion of the door liner 33 defining the rear surface of the door 30. The support protrusion 35 is formed to protrude at a position inwardly spaced apart by a predetermined distance from the edge of the rear surface of the door 30. The support protrusion 35 should be formed in a vertical direction at least at both sides of the door liner. The support protrusion 35 is formed such that the height of its intermediate portion and the height of its upper and lower portions at both side ends of the door liner 33 differ from each other. Particularly, a portion of the support protrusion 35 where a cold air communication portion 55, which will be described below, is provided is formed to have a relatively small height.

Horizontal protrusions 36 are formed to connect both side portions of the support protrusion 35 to each other. A plurality of the horizontal protrusions 36 each of which protrudes to extend from side to side are formed on a rear surface of the door liner 33 and serve to support a door basket 40 which will be described below. A relatively lower end portion of the support protrusion 35, which is formed parallel with the horizontal protrusions 36, may perform the same function as the horizontal protrusion 36. In the embodiment shown in the figures, although the horizontal protrusion 36 is formed to protrude relatively less than the support protrusion 35, it is not necessarily limited thereto.

Catching portions 38 are formed on inner side surfaces of the support protrusion 35 corresponding to both side ends of the horizontal protrusion 36. The catching portions 38 are formed to protrude from the surfaces of the support protrusion 35. The catching portions 38 serve to support the door basket 40, which will be described below, by allowing the door basket 40 to be caught by the catching portions 38. The number of the catching portions 38 to be formed may be changed according to the size of the door basket 40. Stoppers 39 are formed at positions spaced apart by a predetermined distance from upper ends of the catching portions 38. The stoppers 39 serve to prevent the door basket 40 from being separated inadvertently. However, the stoppers 39 protrude less than the catching portions 38 in order not to hinder the door basket 40 from being inserted.

The door basket 40, which is installed on the rear surface of the door 30, is a part in which goods are stored. An accommodation space 41' is defined in a basket body 41 of the door basket 40. The basket body 41 is formed to extend from side to side, and the accommodation space 41' is generally open toward an upper portion of the basket body 41. The basket body 41, which is formed of synthetic resin, may be configured in a variety of shapes.

Connecting skirts 42 are formed at both side ends of the basket body 41 to extend downwardly. The connecting skirts 42 are portions to which both ends of a flow guide 60 to be described below are mounted.

The accommodation space 41' may be divided into left and right sides by a partition plate 43. A side of the accommodation space 41' divided by the partition plate 43 may be covered with a basket cover 45. The basket cover 45 serves to cover the side of the accommodation space 41' from the outside of the storage space. The basket cover 45 moves from side to side along the basket body 41, thus selectively opening and closing the accommodation space 41'.

The cold air communication portion 55 is provided to penetrate through a side surface of the basket body 41. The cold air communication portion 55 is a portion which communicates with a cold air duct formed in the refrigerator main body and is supplied with cold air in a state where the door 30 is closed. Upon review of the structure of the cold air communication portion 55, a through-hole 56 is formed through the side surface extending relatively downward at an end of the basket body 41, i.e., the connecting skirts 42, and a connecting duct 57 is mounted in the through-hole 56. It is preferred that the connecting duct 57 be formed of a somewhat elastic material. The connecting duct 57 is formed to have a substantially cylindrical shape.

The flow guide 60 is provided at a lower end of the basket body 41 to extend from side to side. The flow guide 60 is a portion which substantially defines a flow channel in cooperation with the door liner 33. The flow guide 60 may be formed separately from the basket body 41 and then assembled therewith, or formed integrally with the basket body 41. The present embodiment shows that the flow guide 60 is formed separately from the basket body 41. That is, the flow guide 60 is positioned between the connecting skirts 42 at both the ends of the basket body 41. The assembly of the flow guide 60 and the connecting skirts 42 is effected by means of respective structures formed integrally with the flow guide 60 and the connecting skirts 42 themselves. That is, the structures formed integrally with the flow guide 60 and the connecting skirts 42 which are injection molded are coupled with each other, so that the flow guide 60 and the connecting skirts 42 can be assembled.

For reference, in a case where the portions extending relatively downward at both the ends of the basket body 41, i.e., the connecting skirts 42, are formed integrally with the flow guide 60, the cold air communication portion 55 is formed in the flow guide 60.

A plurality of cold air vents 61 are formed through the flow guide 60. The plurality of cold air vents 61 are formed to penetrate through the flow guide 60. However, in practice, the cold air is discharged only through lower ones of the cold air vents 61.

Figure 5:
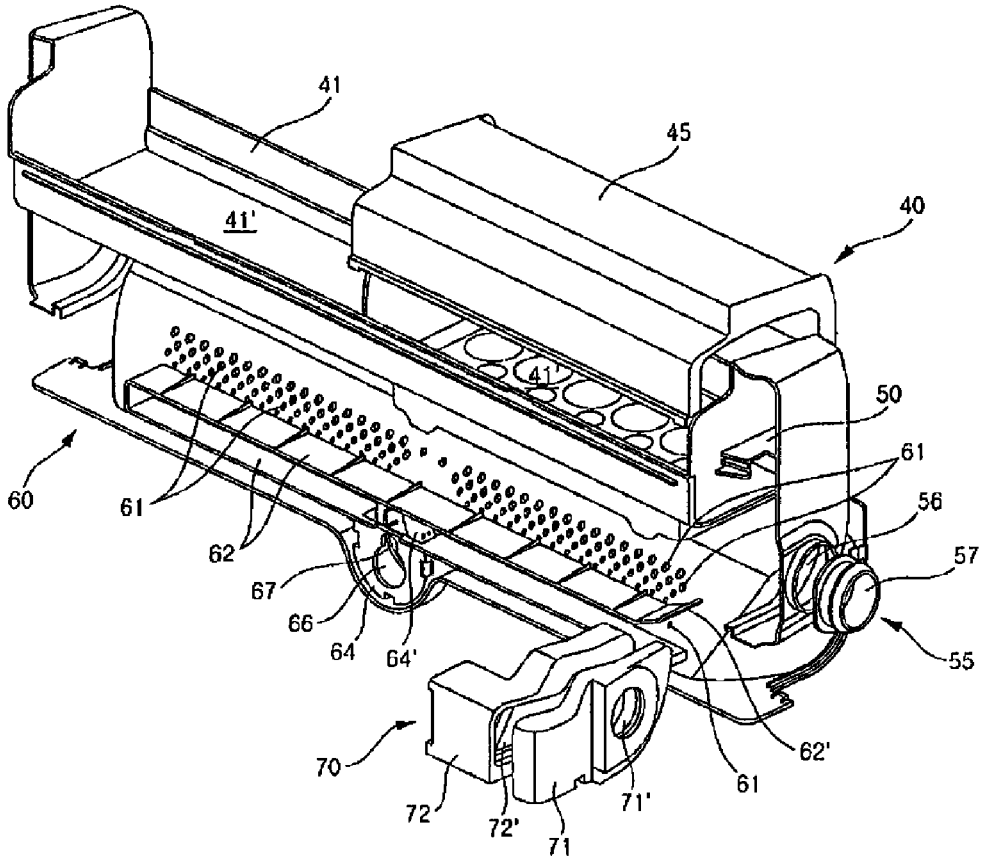
FIG. 5 is an exploded rear perspective view showing the major portions of the embodiment according to the present invention.

To this end, a flow channel formation rib 62, which guides the cold air to the lower ones of the cold air vents 61, is formed to extend in two lines, as well shown in FIG. 5. The flow channel formation rib 62 is formed on a rear surface of the flow guide 60. When the flow guide 60 is mounted on the door liner 33, a distal end of the flow guide 60 is brought into close contact with the door liner 33.

Thus, the cold air flow channel is defined in the flow guide 60 by the door liner 33 and the flow channel formation rib 62 of the flow guide 60. When the flow guide 60 is viewed from the rear side, the entire flow channel formation rib 62 is "ㄷ"-shaped to extend from side to side. According to the configuration of such a flow channel formation rib 62, the cold air is discharged into the storage space through the cold air vents 61 that are positioned in the areas divided by the flow channel formation rib 62.

Here, the flow channel formation rib 62 serves to reinforce the flow guide 60. That is, the flow guide 60 is installed on the rear surface of the door 30 to extend from side to side. Further, since the flow guide 60 should be spaced somewhat apart from the door liner 33 in order to define the flow channel, the flow guide 60 may not be securely supported. However, the flow channel formation rib 62 is supported on the door liner 33, so that it is possible to reinforce the strength of the flow guide 60.

A converging portion 62' is formed at a leading end of the flow channel formation rib 62 upstream of the flow of the cold air. The converging portion 62' serves to reduce a flow cross-sectional area of the cold air in the flow direction of the cold air. Although the converging portion 62' has been formed at one side of the flow channel formation rib 62 in the illustrated embodiment, the converging portion 62' may be formed at both sides of the flow channel formation rib 62 or at only the other side thereof according to design conditions.

A connecting portion 64 is formed to have a substantially cylindrical shape and to be recessed when viewed from the front. The interior of the connecting portion 64 communicates with the flow channel defined by the flow channel formation rib 62 through a communication portion 64'. The communication portion 64' is formed by removing a portion of one side of the flow channel formation rib 62.

Figure 7:
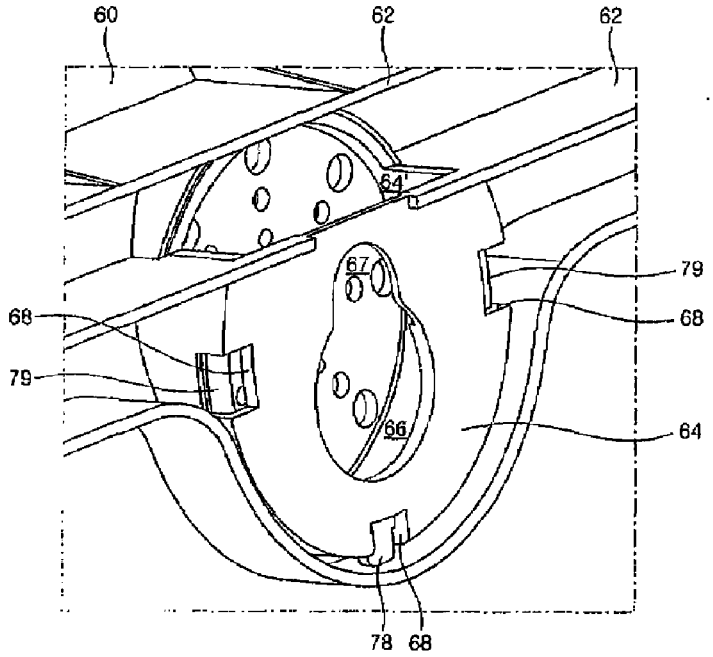
FIG. 7 is a perspective view showing a connecting portion and a mounting cover in the embodiment according to the present invention.
Figure 8:
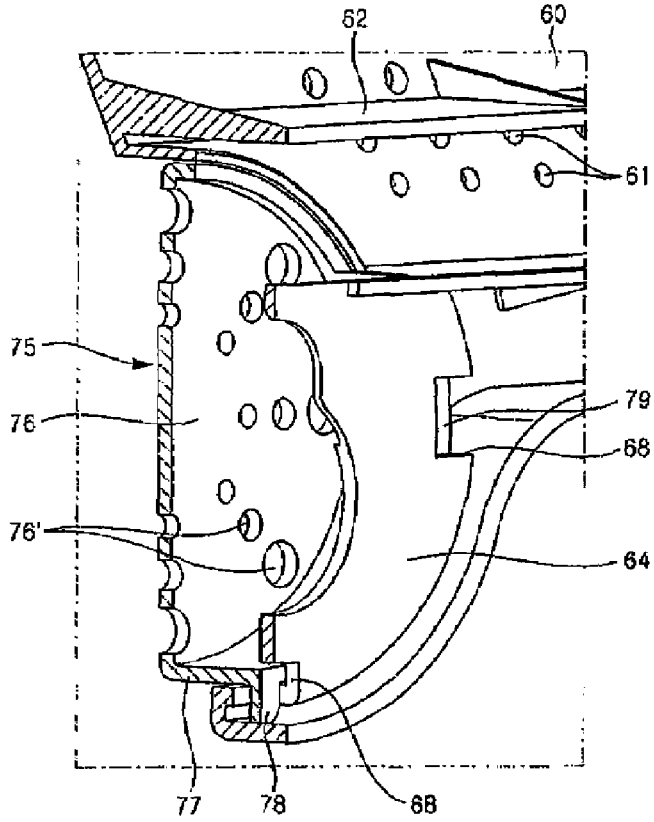
FIG. 8 is a partially sectional perspective view showing the connecting portion and mounting cover in the embodiment according to the present invention.

An insertion hole 66 is formed through a substantially center portion of the connecting portion 64. A catching hole 67 is formed in the connecting portion 64 to communicate with the insertion hole 66. The insertion hole 66 and the catching hole 67 communicating with each other are formed such that the diameter of the catching hole 67 is smaller than that of the insertion hole 66, as well shown in FIG. 7. A connecting neck portion 85 of a supporting/catching member 80 which will be described below is caught in the catching hole 67.

A plurality of catching slots 68 are formed around an inner peripheral portion of the connecting portion 64. In this embodiment, a total of three catching slots 68 are formed. The catching slots 68 are portions in which an insertion guide 78 and catching hooks 79 of a mounting cover 75 which will be described below are caught.

In the meantime, as shown in FIG. 5, there is provided an insulation flow channel body 70 to ensure communication of the cold air communication portion 55 with the space between both the sides of the flow channel formation rib 62. This is because the flow channel defined by the flow channel formation rib 62 and the cold air communication portion 55 cannot directly communicate with each other due to the structure of the flow guide 60. The insulation flow channel body 70 is formed of a material with superior thermal insulation property, such as an EPS material so-called Styrofoam, in the present embodiment. The insulation flow channel body 70 serves to deliver the cold air introduced through the cold air communication portion 55 into the flow channel defined by the flow channel formation rib 62 and simultaneously to prevent dewdrops from being formed on the flow guide 60 near the cold air communication portion 55.

Figure 6:
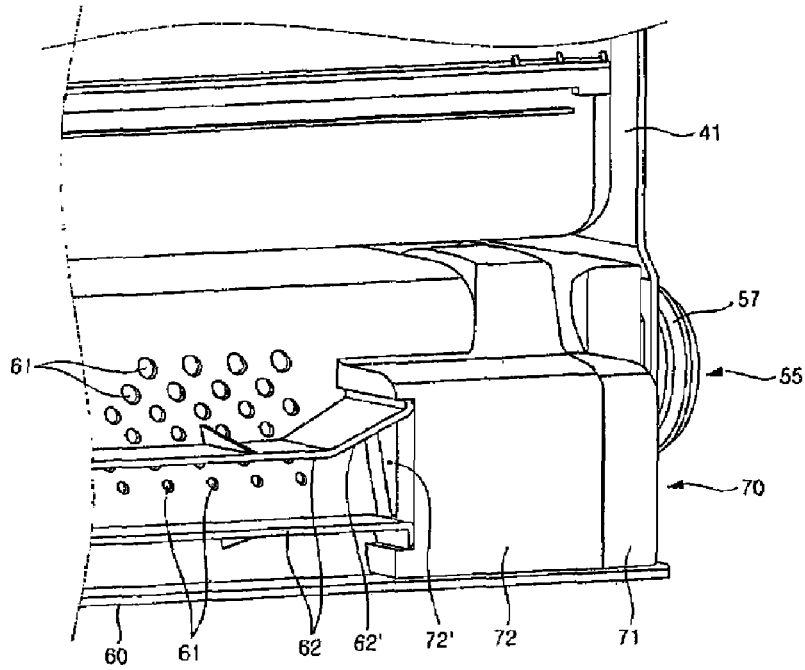
FIG. 6 is a rear perspective view showing the major portion of the embodiment according to the present invention.

The insulation flow channel body 70 comprises a first flow channel body 71 and a second flow channel body 72. The first flow channel body 71 is formed with a flow channel inlet 71' communicating with the cold air communication portion 55, while the second flow channel body 72 is formed with a communication passage 72' for making the flow channel inlet 71' to communicate with the space between both the sides of the flow channel formation rib 62. Of course, the coupling of the first flow channel body 71 and the second flow channel body 72 causes the inlet 71' and the communication passage 72' to communicate with each other. It is not necessary that the insulation flow channel body 70 comprises the two parts. The insulation flow channel body 70 may comprise a number of parts according to design conditions. The external appearance of the insulation flow channel body 70 is changed according to the shape of the flow guide 60. An installation state of the insulation flow channel body 70 is well shown in FIG. 6.

For reference, it is preferred that a flow cross-sectional area of the inlet 71' or the communication passage 72' of the insulation flow channel body 70 be not larger than that of the cold air communication portion 55. This is to prevent the flowability of the cold air from decreasing when the flow cross-sectional area of the cold air is rapidly increased.

Figure 4:
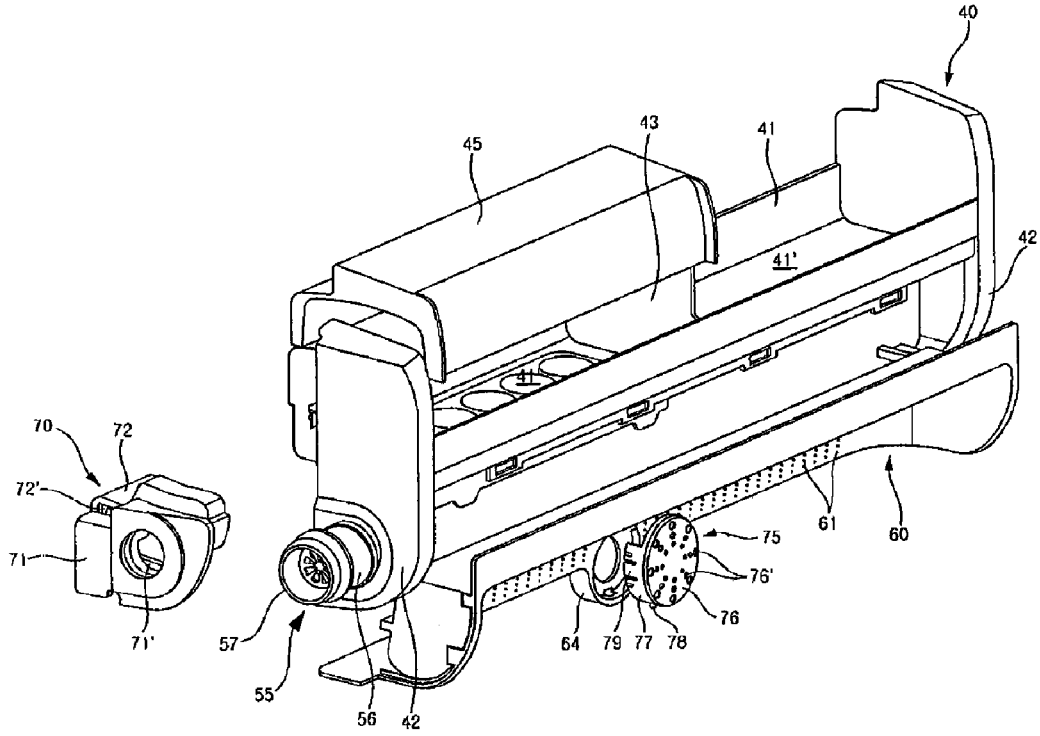
FIG. 4 is an exploded front perspective view showing major portions of the embodiment according to the present invention.

As well shown in FIG. 4, the mounting cover 75 is mounted on the connecting portion 64. The mounting cover 75 is seated on the connecting portion 64 to be exposed to the front of the flow guide 60. The mounting cover 75 itself contains, for example, an anion generating component or deodorization component. Such a component is defined as a cold air purification component in the present invention.

Thus, the anion generating component or deodorization component is transferred to the cold air while the cold air passes through the mounting cover 75, so that anions can be mixed with the cold air and the mixture can flow, or an odor can be removed. The anion generating component or deodorization component is contained in the mounting cover 75 when it is injection molded.

The mounting cover 75 is shaped and sized to be seated in the connecting portion 64 that is concavely formed. That is, the mounting cover 75 is formed in a substantially circular disk shape in the present embodiment. The mounting cover 75 is provided with a circular front plate 76. The front plate 76 is formed with cold air vents 76' through which the cold air flowing in the connecting portion 64 is discharged to the outside.

A sidewall 77 is formed around the edge of the front plate 76 to extend rearward. The sidewall 77 is not formed at a portion corresponding to the communication portion 64'. This is to avoid hindrance to introduction of the cold air into the connecting portion 64. The insertion guide 78 is formed at a side of the sidewall 77. The insertion guide 78 serves to guide the mounting cover 75 to an insertion position. The sidewall 77 is also formed with the catching hooks 79 for fixing the mounting cover 75 to the connecting portion 64. The catching hooks 79 are formed to be elastically deformed by cutting a portion of the sidewall 77.

Figure 9:
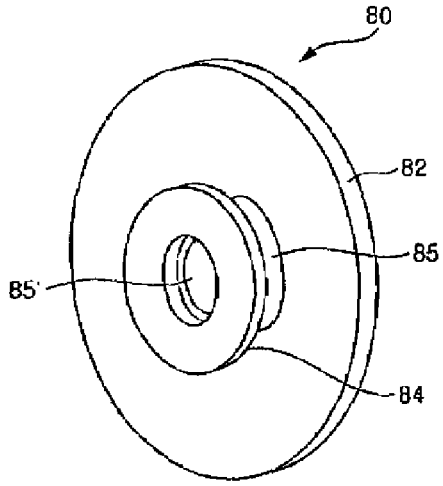
FIG. 9 is a perspective view showing a supporting/catching member in the embodiment according to the present invention.
Figure 10:
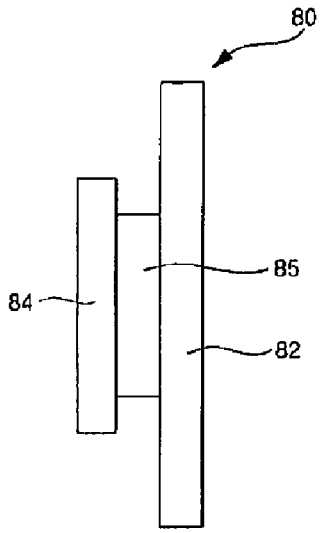
FIG. 10 is a side view showing the supporting/catching member in the embodiment according to the present invention.

Next, the configuration of the supporting/catching member 80 for coupling the connecting portion 64 of the flow guide 60 to the door liner 33 will be described with reference to FIGS. 9 and 10. The supporting/catching member 80 is mounted to the door liner 33. The central lower portion of the flow guide 60 is caught by the supporting/catching member 80, so that the supporting/catching member 80 can support the flow guide 60. Although the supporting/catching member 80 is configured to be fastened to the door liner 33 with screws in the present embodiment, it is not necessarily so. That is, the supporting/catching member 80 may be formed integrally with the door liner 33.

The supporting/catching member 80 of the present embodiment is provided with a mounting plate 82. The mounting plate 82 is a portion which is mounted on the door liner 33. A catching plate 84 is provided in the front of the mounting plate 82 to be connected thereto through the connecting neck portion 85. The catching plate 84 is shaped and sized to pass through the insertion hole 66 of the connecting portion 64. In the present embodiment, since the insertion hole 66 takes the shape of a circle with a predetermined diameter, the catching plate 84 also takes the shape of a circular disk with a diameter equal to or less than that of the insertion hole 66. The connecting neck portion 85 has a diameter corresponding to that of the catching hole 67 of the connecting portion 64. The length of the connecting neck portion 85, i.e., the distance between the catching plate 84 and the mounting plate 82, is formed to be equal to or somewhat larger than the thickness of a rim of the catching hole 67. Reference numeral 85' designates a fastening hole for mounting the supporting/catching member 80 on the door liner 33.

MODE FOR INVENTION

Figure 11:
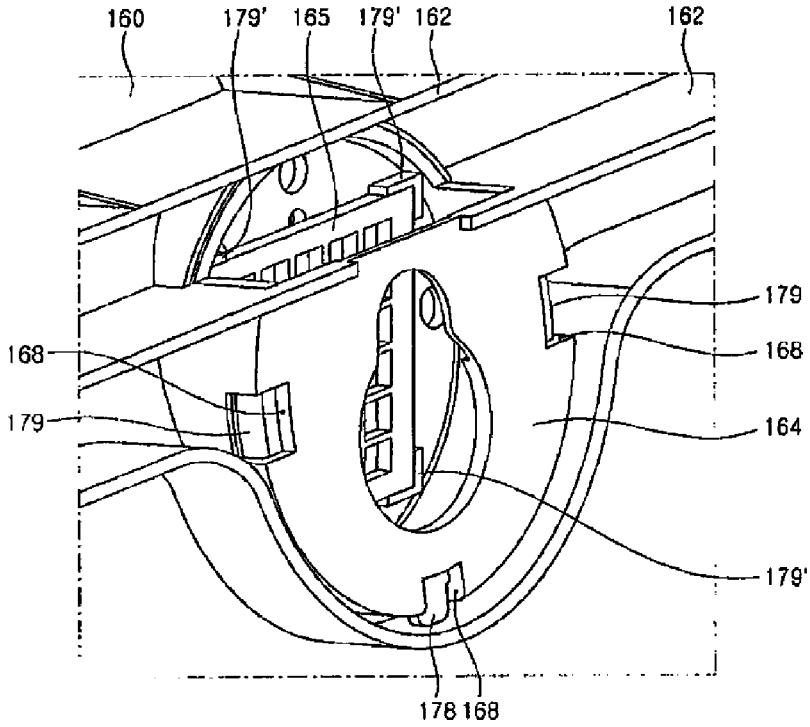
FIG. 11 is a perspective view showing major portions of another embodiment of the present invention.
Figure 12:
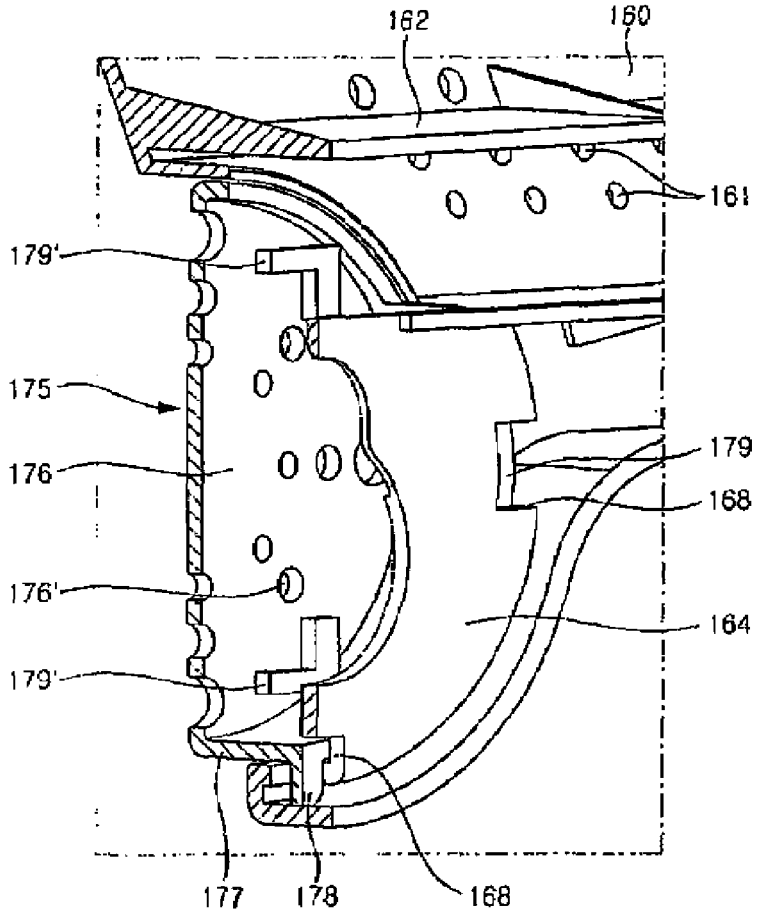
FIG. 12 is a partially sectional perspective view showing the major portions of the other embodiment according to the present invention.

Next, FIGS. 11 and 12 show another embodiment of the present invention. In the present embodiment, for convenience of description, reference numerals increased by one hundred are given to elements corresponding to those of the previous embodiment.

In the present embodiment, a deodorizer 165 is positioned in a connecting portion 164. That is, while the mounting cover 75 itself functions as a deodorizer in the previous embodiment, the separate deodorizer 165 is used in the present embodiment. Although the deodorizer 165 is formed to have the shape of a quadrangular plate with a plurality of vents in the present illustrated embodiment, it is not necessarily so. The deodorizer 165 may be configured to be inserted into a sidewall 177 of a mounting cover 175, which will be described below.

In order to install the deodorizer 165, fixing ribs 179' are formed on a rear surface of a front plate 176 of the mounting cover 175. The fixing ribs 179' are formed at positions corresponding to four corners of the deodorizer 165 so that the four corners of the deodorizer 165 are fitted into the fixing ribs 179'. The deodorizer 165 is attached to the rear surface of the mounting cover 175 by the fixing ribs 179', so that the cold air introduced into the connecting portion 164 can always pass through the deodorizer 165.

Figure 13:
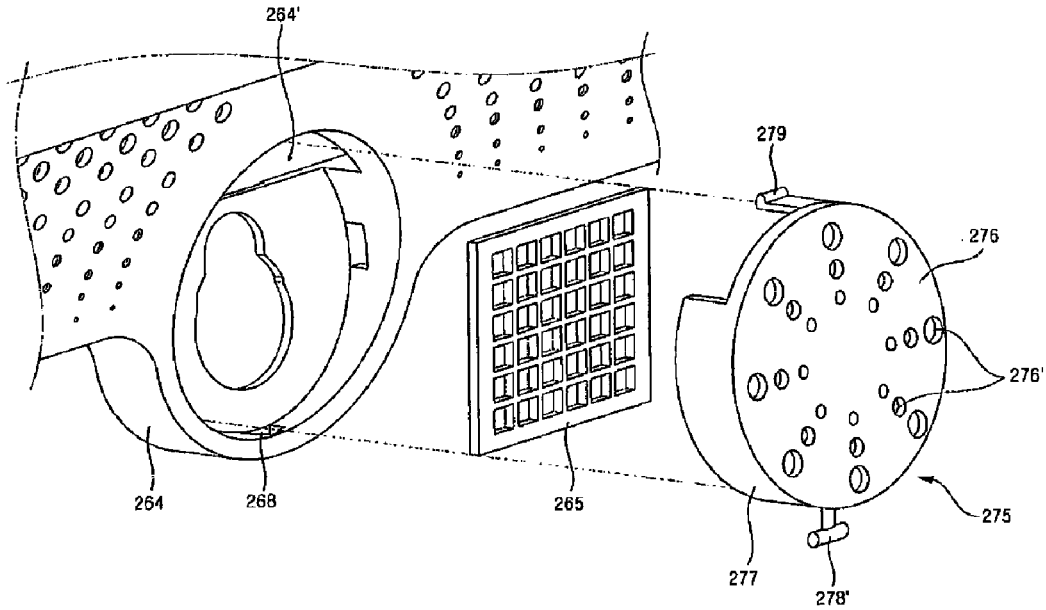
FIG. 13 is an exploded perspective view showing major portions of a further embodiment of the present invention.

In the meantime, FIG. 13 shows a further embodiment of the present invention. In the present embodiment, for convenience of description, reference numerals increased by two hundred are given to elements corresponding to those of the embodiment shown in FIG. 6.

A connecting portion 264 is formed to have a cylindrical shape and to be inwardly recessed when viewed from the front. Cold air is supplied to the interior of the connecting portion 264 through a communication portion 264'. A hinge slot 268 is formed at a lower end side of the connecting portion 264. A deodorizer 265 is positioned in the connecting portion 264. The deodorizer 265 may have various shapes. It is preferred that the deodorizer 265 be mounted on a rear surface of a front plate 276 of a mounting cover 275, which will be described below.

The interior of the connecting portion 264 is selectively covered with the mounting cover 275. The mounting cover 275 is shaped and sized to be seated in the connecting portion 264. A plurality of cold air vents 276' are formed through the circular disk-shaped front plate 276 of the mounting cover 275. A sidewall 277 is formed around the edge of the front plate 276 to extend rearward. The sidewall 277 is continuously formed with the exception of a portion corresponding to the communication portion 164'.

A hinge portion 278' is provided in a portion of the sidewall 277 opposite to the communication portion 264'. The hinge portion 278' is pivotably caught in the hinge slot 268, so that the mounting cover 275 can selectively open and close the interior of the connecting portion 264. A catching hook 279 is formed at a side of the front plate 276 opposite to the hinge portion 278'. The catching hook 279 causes the mounting cover 275 to be caught by the connecting portion 264.

Figure 14:
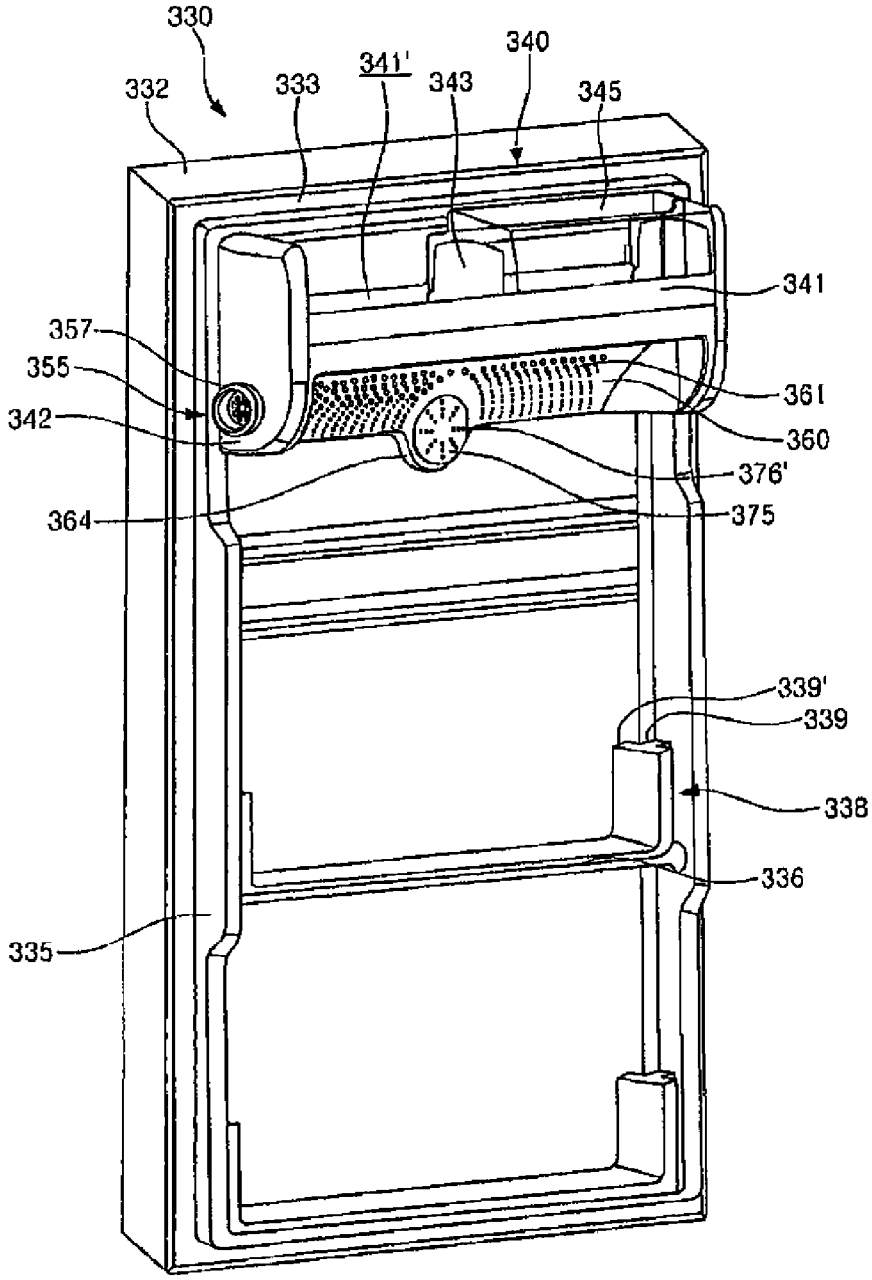
FIG. 14 is a perspective view showing a configuration of a still further embodiment of the present invention.
Figure 15:
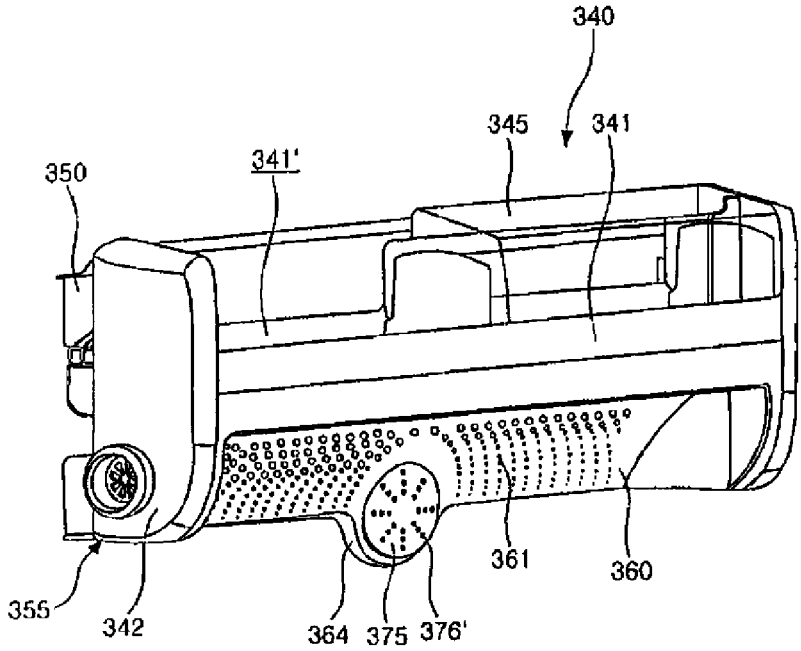
FIG. 15 is a perspective view showing major portions of the embodiment shown in FIG. 14.

In the meantime, FIGS. 14 and 15 show a still further embodiment of the present invention. In the present embodiment, for convenience of description, reference numerals increased by three hundred are used, and only major portions will be described.

In the present embodiment, a cold air communication portion 355 for supplying cold air into a cold airflow channel defined by a door liner 333, a basket body 341 and a flow guide 360 is not formed in a support protrusion 335 of a door 330, but is formed in the basket body 341 and caught by and mounted on a catching portion 338 formed on the door liner 333. To this end, the basket body 341 is formed with hook portions 350, which are caught by the catching portion 338 formed on the door liner 333. At this time, the hook portions 350 of the basket body 341 should be configured in a shape corresponding to that of the catching portion 338 of the door liner 333 so that they can be caught by the catching portion 338 of the door liner 333.

For reference, the catching portion 338 formed on the door liner 333 comprises guide portions 339 vertically extending from a surface of the door liner 333, and catching pieces 339' formed vertically to the guide portions 339 at leading ends thereof. The hook portions 350 formed on the basket body 341 are shaped to be inserted into a space between the door liner 333 and the catching pieces 339' corresponding to both ends of the guide portions 339.

Hereinafter, the operation of the door duct assembly for a refrigerator according to the present invention constructed as above will be described in detail.

Figure 16:
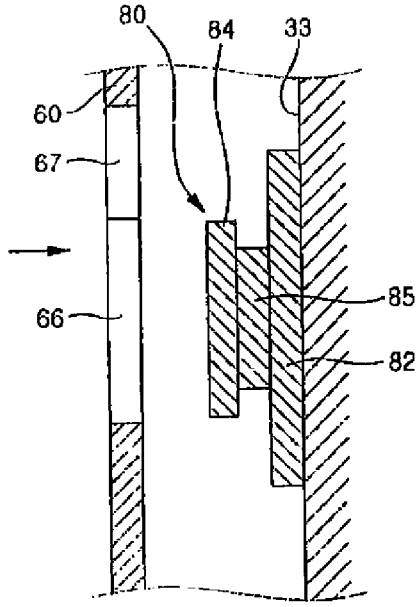
FIGS. 16 to 18 are views sequentially showing an assembling process in which a flow guide is caught by the supporting/catching member in the embodiment shown in FIG. 3.
Figure 17:
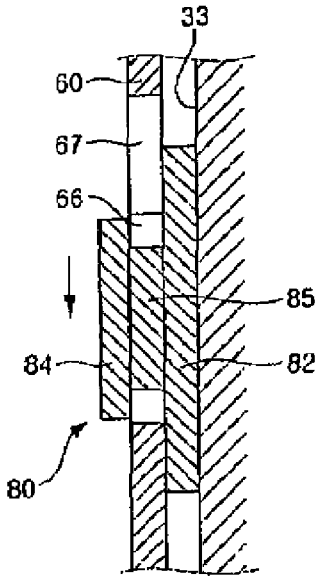

In the present invention, while being coupled to the basket body 41, the flow guide 60 is mounted together with the basket body 41 on the door liner 33 of the door 30. That is, the basket body 41 is brought into close contact with the door liner 33 of the rear surface of the door 30 so that hook portions 50 of the basket body 41 can be placed at positions corresponding to upper portions of the catching portions 38. That is, the flow guide 60 is moved from a state shown in FIG. 16 to a state shown in FIG. 17 in a direction designated by an arrow. At this time, the catching plate 84 of the supporting/catching member 80 passes through the insertion hole 66 of the connecting portion 64.

Figure 18:
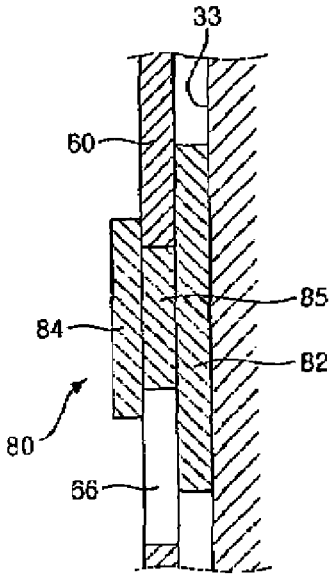

In such a state, the basket body 41 is moved downward in a state where the rear end of the basket body 41 is in close contact with the door liner 33 so that the hook portions 50 are caught by the catching portions 38. That is, the basket body 41, i.e., the flow guide 60, is moved from the state shown in FIG. 17 to a state shown in FIG. 18 in a direction designated by an arrow.

The basket body 41 moves downward, and thus the hook portions 50 go over the stoppers 39 and are caught by the catching portions 38. In such a state, due to the stoppers 39, only when a force of a predetermined value or more is applied to the basket body 41, the hook portions 50 go over the stoppers 39 and are separated from the door liner 33. That is, the door basket 40 is not easily separated from the door liner 33 with a certain force. In addition, the connecting neck portion 85 of the supporting/catching member 80 is caught in the catching hole 67, and the catching plate 84 is positioned in the connecting portion 64.

When the flow guide 60 is mounted together with the basket 40 on the door liner 33 as described above, a distal end of the flow channel formation rib 62 formed on the rear surface of the flow guide 60 is brought into close contact with the door liner 33. Therefore, the flow channel formation rib 62 and the door liner 33 define the flow channel.

In the door duct assembly of the present invention, when the door 30 closes the storage space of the refrigerator main body, the cold air communication portion 55 communicates with the cold air duct of the refrigerator main body and thus is supplied with the cold air. The cold air delivered to the cold air communication portion 55 is delivered to the flow channel defined by the flow channel formation rib 62 through the insulation flow channel body 70.

That is, the insulation flow channel body 70 is inserted into the rear surface portion of the flow guide 60, so that the inlet 71' can be connected to the connecting duct 57. In addition, the communication passage 72' in communication with the inlet 71' communicates with the flow channel defined by the flow channel formation rib 62. Therefore, the cold air delivered from the cold air duct of the refrigerator main body to the connecting duct 57 flows to the flow channel defined by the flow channel formation rib 62 through the insulation flow channel body 70.

Since the flow cross-sectional areas of the inlet 71' and the communication passage 72' of the insulation flow channel body 70 through which the cold air passes are not larger than that of the connecting duct 57, the cold air passing therethrough can smoothly flows. In addition, the flow channel defined between both the sides of the flow channel formation rib 62 also has the flow cross-sectional area which is partially small at the converging portion 62' upstream of the flow channel, so that the smooth flow can be maintained.

The cold air flowing between both the sides of the flow channel formation rib 62 flows along the flow channel formation rib 62 and is discharged into the storage space of the refrigerator through the cold air vents 61 in the area divided by the flow channel formation rib 62. For reference, the cold air also flows into the connecting portion 64 through the communication portion 64', so that the cold air delivered to the connecting portion 64 can be discharged through the cold air vents 76' of the mounting cover 75.

The cold air passing through the mounting cover 75 is discharged into the storage space in a state where an odor is removed from the cold air by the cold air purification component or anions are supplied to the cold air. Thus, the cold air purified by the cold air purification component keeps the storage space cleaner. In addition, the cold air supplies anions to the stored goods, so that the stored goods can be kept fresher.

In the meantime, the processes of dismounting and mounting the mounting cover 75 from and to the connecting portion 64 will be described. First, the insertion guide 78 formed on the sidewall 77 of the mounting cover 75 is positioned in one of the catching slots 68. Next, the catching hooks 79 are inserted into the others of the catching slots 68. While being inserted into the catching slots 68, the catching hooks 79 are elastically deformed and then are restored to an initial state, so that the catching hooks 79 can be kept to be caught in the catching slots 68. In addition, the mounting cover 75 may be separated from connecting portion 64 by elastically deforming one of the catching hooks 79. Therefore, a user may replace the mounting cover 75 when the cold air purification component of the mounting cover 75 is exhausted.

Furthermore, in the embodiment shown in FIGS. 11 and 12, the deodorizer 165 is inserted into and installed at the fixing ribs 179' formed on a rear surface of the front plate 176 of the mounting cover 175. The deodorizer 165 thus installed serves to remove an odor when the cold air delivered to the connecting portion 164 is discharged through cold air vents 176' of the mounting cover 175.

Meanwhile, in the embodiment shown in FIG. 13, the mounting cover 275 is pivotably connected to the hinge portion 278' of the connecting portion 264. Therefore, in order to replace the deodorizer 265, a user separates the catching hook 279 from the connecting portion 264 and rotates the mounting cover 275 about the hinge portion 278'.

Then, after replacing the deodorizer 265, the user causes the catching hook 279 to be caught by the connecting portion 264 by rotating the mounting cover 275 about the hinge portion 278'.

Furthermore, in the embodiment shown in FIGS. 14 and 15, the basket body 341 with the flow guide 360 mounted thereon is mounted by causing the hook portions 350 to be caught by the catching portion 338 of the door liner 333.

The scope of the present invention is not limited to the embodiments described above but is defined by the appended claims. It will be apparent that those skilled in the art can make various modifications and changes thereto within the scope of the invention defined by the claims.

For example, as briefly explained above, the cold air communication portion 55 may be provided in the flow guide 60 rather than the basket body 41. At this time, the flow guide 60 should be formed with a portion corresponding to the connecting skirt 42 of the basket body 41 that is provided with the cold air communication portion 55. In addition, the flow guide 60 may be mounted on the door liner 33 in a state where the flow guide 60 is mounted on the basket body 41 or is provided with additional hook portions and the like.

Further, in the present invention, the deodorizer 165 is not necessarily mounted on the rear surface of the front plate 176 of the mounting cover 175, but it is sufficient that the deodorizer is positioned in a space defined by the connecting portion 164 and the mounting cover 175.

Furthermore, in the present invention, it is possible to directly connect the flow channels formed in the cold air communication portion 55 and the door 30 to each other without using the insulation flow channel body 70. To this end, the flow channel formation rib 62 on the rear surface of the flow guide 60 should be formed at a position adjacent to the cold air communication portion 55.

INDUSTRIAL APPLICABILITY

The present invention makes it possible to more rapidly set a storage space to a desired temperature by delivering cold air from a door side into the storage space. Thus, the present invention may be applied to a refrigerator with a door for opening and closing the storage space.

The invention claimed is:

1. A door duct assembly for a refrigerator, comprising:

a cold air communication portion detachably installed on a door for opening and closing a storage space of a refrigerator main body, the cold air communication portion including a connecting duct selectively connected to a cold air duct of the refrigerator main body;

a flow guide for defining a flow channel in cooperation with a door liner defining a rear surface of the door, the flow channel allowing a cold air supplied through the cold air communication portion to flow therethrough, the flow guide having a rear surface on which a flow channel formation rib is provided to define the flow channel; and an insulation flow channel body causing the flow channel defined by the flow guide and the cold air communication portion to communicate with each other, the insulation flow channel body being installed by inserting at least two flow channel bodies made of an insulating material into the rear surface portion of the flow guide.

2. The door duct assembly as claimed in claim 1, wherein the flow channel formation rib has a distal end that comes into contact with the door liner to define the flow channel with a flow cross-sectional area that is not larger than that of the connecting duct, and a flow channel defined in the insulation flow channel body has a flow cross-sectional area that is formed not to be larger than that of the connecting duct.

3. The door duct assembly as claimed in claim 1, wherein the insulation flow channel body comprises a first flow channel body having an inlet in communication with the connecting duct, and a second flow channel body formed with a communication passage having a side communicating with the inlet of the first flow channel body and the other side communicating with the flow channel defined by the flow channel formation rib.

4. The door duct assembly as claimed in claim 3, wherein the cold air communication portion is formed to penetrate through one of connecting skirts downward extending at both ends of a door basket, and both ends of the flow guide are positioned between the connecting skirts at both the ends of the door basket.

5. The door duct assembly as claimed in claim 4, wherein the flow channel formation rib is "ㄷ"-shaped to be elongated in a widthwise direction on the rear surface of the flow guide, and is further provided with a converging portion upstream of a flow of the cold air, the converging portion causing the cross-sectional area of the flow of the cold air to be reduced.

6. The door duct assembly as claimed in claim 5, wherein a plurality of cold air vents are formed at an area of the flow guide divided by the flow channel formation rib, and the cold air is discharged into the storage space through the cold air vents in the area divided by the flow channel formation rib.

7. The door duct assembly as claimed in claim 1, wherein a connecting portion is further provided in an intermediate portion of the flow guide, the connecting portion comprising an insertion hole and a catching hole communicating therewith, the insertion hole and the catching hole having different diameters from each other and communicating with the flow channel defined by the flow guide and the door liner, the cold air is supplied to and discharged through the insertion hole and catching hole, and the door liner further comprises a supporting/catching member at position corresponding to the connecting portion, the supporting/catching member comprising a catching plate with a diameter larger than that of the catching hole at a distal end of a connecting neck portion with a relatively smaller diameter, thereby enabling the connecting portion to be caught and supported by the supporting/catching member.

8. The door duct assembly as claimed in claim 7, wherein the connecting portion is formed to be recessed when viewed from the front of the flow guide, and a plurality of catching slots are formed around an inner peripheral portion of the connecting portion.

9. The door duct assembly as claimed in claim 8, wherein a mounting cover is detachably mounted on the connecting portion, the mounting cover comprising a front plate which covers the interior of the connecting portion and through which a plurality of cold air vents are formed, and a side wall formed with an insertion guide and a catching hook around an edge of the front plate, the insertion guide and the catching hook being caught in the catching slots.

10. The door duct assembly as claimed in claim 9, wherein the mounting cover is formed to contain at least one of a deodorization component and an anion generating component.

11. The door duct assembly as claimed in claim 9, wherein a deodorizer for removing an odor from the cold air is further provided within the connecting portion covered with the mounting cover.

12. The door duct assembly as claimed in claim 11, wherein the deodorizer is fixed to a rear surface of the front plate defining the front surface of the mounting cover, and a fixing rib into which an edge of the deodorizer is fitted is provided on the rear surface of the front plate.

13. A door duct assembly for a refrigerator, comprising:

a cold air communication portion detachably installed on a door for opening and closing a storage space of a refrigerator main body, the cold air communication portion including a connecting duct selectively connected to a cold air duct of the refrigerator main body;

a flow guide for defining a flow channel in cooperation with a door liner defining a rear surface of the door, the flow channel allowing a cold air supplied through the cold air communication portion to flow therethrough, the flow guide being formed with a plurality of cold air vents for discharging the cold air into the storage space;

a connecting portion formed in a portion of the flow guide, the connecting portion communicating with the flow channel defined by the flow guide and the door liner and being supplied with the cold air and discharging the cold air;

a mounting cover detachably installed on the connecting portion to selectively open and close the interior of the connecting portion, the mounting cover comprising a plurality of cold air vents; and a deodorizer installed within the connecting portion covered with the mounting cover to remove an odor from the cold air.

14. The door duct assembly as claimed in claim 13, wherein the connecting portion is formed to be recessed when viewed from the front of the flow guide, and a plurality of catching slots are formed around an inner peripheral portion of the connecting portion.

15. The door duct assembly as claimed in claim 14, wherein the mounting cover comprises a front plate which covers the interior of the connecting portion and through which the plurality of cold air vents are formed, and a sidewall formed with an insertion guide and a catching hook around an edge of the front plate, the insertion guide and the catching hook being caught in the catching slots.

16. The door duct assembly as claimed in claim 14, wherein the mounting cover comprises a front plate which covers the interior of the connecting portion and through which the plurality of cold air vents are formed, a side wall formed around an edge of the front plate, a hinge portion causing the mounting cover to be pivotably connected to the connecting portion, and a catching hook installed at a position opposite to the hinge portion, the catching hook causing the mounting cover to be caught by and fixed to the connecting portion.

17. The door duct assembly as claimed in claim 15, wherein the deodorizer is fixed to a rear surface of a front plate, and a fixing rib for fixing the deodorizer is provided on the rear surface of the front plate.

18. The door duct assembly as claimed in claim 13, wherein the mounting cover is formed to contain at least one of a deodorization component and an anion generating component.

19. A door duct assembly mounting structure for a refrigerator, comprising:

a cold air communication portion detachably installed on a door for opening and closing a storage space of a refrigerator main body, the cold air communication portion including a connecting duct selectively connected to a cold air duct of the refrigerator main body;

a flow guide for defining a flow channel in cooperation with a door liner defining a rear surface of the door, the flow channel allowing a cold air supplied through the cold air communication portion to flow therethrough, the flow guide being formed with a plurality of cold air vents for discharging the cold air into the storage space, the flow channel having both ends caught by the door liner;

a connecting portion formed at an intermediate portion of the flow guide, the connecting portion communicating with the flow channel defined by the flow guide and the door liner and being supplied with the cold air and then discharging the cold air, the connecting portion comprising an insertion hole and a catching hole that are communicate with each other and have different diameters; and a supporting/catching member provided on the door liner at a position corresponding to the connecting portion, the supporting/catching member comprising a catching plate with a diameter larger than that of the catching hole at a distal end of a connecting neck portion with a relatively smaller diameter, thereby enabling the connecting portion to be caught and supported by the supporting/catching member.

20. The door duct assembly mounting structure as claimed in claim 19, wherein the flow guide is coupled to a door basket installed on the rear surface of the door, and hook portions are formed at both ends of the door basket to be caught by catching portions formed on the door liner.

21. The door duct assembly mounting structure as claimed in claim 19, wherein hook portions are formed at both ends of the flow guide to be caught by catching portions formed on the door liner, and the cold air communication portion is provided to penetrate through any one of both the ends thereof.

22. The door duct assembly mounting structure as claimed in claim 20, wherein stoppers are formed above the catching portions formed on the door liner, the stoppers protruding less than the catching portions to prevent the door basket or the flow guide from being detached.

23. The door duct assembly mounting structure as claimed in claim 22, wherein the supporting/catching member comprises a mounting plate mounted on the door liner, a connecting neck portion provided on the mounting plate to have a length corresponding to the thickness of a rim of the catching hole, and a catching plate provided at the distal end of the connecting neck portion so as to correspond to the shape and size of the insertion hole.

24. The door duct assembly mounting structure as claimed in claim 23, wherein a deodorizer is fixed to a rear surface of a front plate, and a fixing rib for fixing the deodorizer is provided on the rear surface of the front plate.

25. The door duct assembly mounting structure as claimed in claim 23, wherein the mounting cover is formed to contain at least one of a deodorization component and an anion generating component.

* * * * *